US007681952B2

(12) United States Patent
Piretti

(10) Patent No.: US 7,681,952 B2
(45) Date of Patent: Mar. 23, 2010

(54) CHAIR WITH TILTABLE BACKREST

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 0 days.

(21) Appl. No.: 12/134,752

(22) Filed: Jun. 6, 2008

(65) Prior Publication Data

US 2009/0302654 A1 Dec. 10, 2009

(51) Int. Cl.
*A47C 3/00* (2006.01)
*A47C 1/024* (2006.01)

(52) U.S. Cl. ..... 297/297; 297/301.3

(58) Field of Classification Search ..... 297/299, 297/297, 301.1, 301.3, 301.7, 303.3, 296
See application file for complete search history.

(56) References Cited

U.S. PATENT DOCUMENTS

| | | | | |
|---|---|---|---|---|
| 960,607 | A * | 6/1910 | Wersel, Jr. | 297/293 |
| 1,205,541 | A * | 11/1916 | Hoehn | 297/297 |
| 3,337,265 | A | 8/1967 | Benzing | |
| 4,585,272 | A | 4/1986 | Ballarini | |
| 4,652,050 | A | 3/1987 | Stevens | |
| 4,653,806 | A | 3/1987 | Willi | |
| 4,830,430 | A * | 5/1989 | Schafer | 297/298 |
| 4,890,886 | A | 1/1990 | Opsvick | |
| 4,981,326 | A | 1/1991 | Heidmann | |
| 5,039,163 | A | 8/1991 | Tolleson | |
| 5,080,318 | A | 1/1992 | Takamatsu et al. | |
| 5,224,758 | A | 7/1993 | Takamatsu et al. | |
| 5,348,372 | A | 9/1994 | Takamatsu et al. | |
| 5,452,937 | A | 9/1995 | Piretti | |
| 5,580,127 | A | 12/1996 | Piretti | |
| 5,775,774 | A | 7/1998 | Okano | |
| 5,810,438 | A | 9/1998 | Newhouse | |
| 5,988,746 | A | 11/1999 | Raferty | |
| 6,070,937 | A | 6/2000 | Ginat | |
| 6,250,715 | B1 | 6/2001 | Caruso et al. | |
| 6,367,876 | B2 | 4/2002 | Caruso et al. | |
| 6,386,636 | B2 | 5/2002 | Caruso et al. | |
| 6,533,352 | B1 | 3/2003 | Glass et al. | |

(Continued)

FOREIGN PATENT DOCUMENTS

DE 20 2007 000 623 3/2007

(Continued)

OTHER PUBLICATIONS

EP Search Report for Application No. EP 09160800 dated Oct. 14, 2009.

*Primary Examiner*—Milton Nelson, Jr.
(74) *Attorney, Agent, or Firm*—Patterson & Sheridan, L.L.P.

(57) ABSTRACT

A chair having a base adapted to support the chair on a support surface, and a seat and backrest mounted on the base that includes a flexible backrest and a relatively simple tilt mechanism for tilting the backrest relative to the seat. The tilt mechanism includes a pair of dual cantilevered U-shaped springs mounted on opposite sides of the base and in communication with the backrest. The backrest is mounted to the tilt mechanism such that a rearward thrust applied by the user deflects an outer end of each U-shaped spring downwardly to enable rearward tilting of the backrest relative to the seat. Upon removal of the rearward thrust, the backrest elastically returns to its initial position under the biasing force of the U-shaped springs.

7 Claims, 5 Drawing Sheets

U.S. PATENT DOCUMENTS

| | | | | |
|---|---|---|---|---|
| 6,582,019 | B2 | 6/2003 | Insalaco et al. | |
| 6,598,937 | B2 | 7/2003 | Caruso et al. | |
| 6,739,663 | B2 | 5/2004 | Gevaert | |
| 6,779,846 | B2 | 8/2004 | Spendlove et al. | |
| 6,820,934 | B2 * | 11/2004 | Ware et al. | 297/285 |
| 6,932,431 | B2 | 8/2005 | Koch et al. | |
| 6,959,965 | B2 | 11/2005 | Diffrient | |
| 7,004,543 | B2 | 2/2006 | Caruso et al. | |
| 7,118,177 | B2 | 10/2006 | Piretti | |
| 7,213,880 | B2 | 5/2007 | Schmitz et al. | |
| 7,213,886 | B2 | 5/2007 | Schmitz et al. | |
| 7,249,802 | B2 | 7/2007 | Schmitz et al. | |
| 2002/0117883 | A1 | 8/2002 | Gevaert | |
| 2004/0140701 | A1 | 7/2004 | Schmitz et al. | |
| 2004/0183350 | A1 | 9/2004 | Schmitz et al. | |
| 2006/0091715 | A1 | 5/2006 | Schmitz et al. | |
| 2006/0202536 | A1 | 9/2006 | Luchetti et al. | |
| 2006/0220431 | A1 | 10/2006 | Kwa | |

FOREIGN PATENT DOCUMENTS

| | | | |
|---|---|---|---|
| EP | 0 815 779 | | 1/1998 |
| EP | 1 854 378 | | 11/2007 |
| WO | WO9103192 | * | 3/1991 |

* cited by examiner

CHAIR WITH TILTABLE BACKREST

BACKGROUND OF THE INVENTION

This invention relates to seating furniture, and more particularly to seating furniture such as a chair, which incorporates a tilt mechanism for allowing tilting of the backrest relative to the seat.

A conventional reclining chair typically includes a base interconnected with a seat and backrest. The seat is typically mounted in a fixed position relative to the base, and a tilt mechanism is disposed between the backrest and the seat for providing a means for tilting the backrest rearwardly relative to the seat when a rearward force is applied to the backrest by a user and elastically returning the backrest to its initial position upon removal of the rearward force It is an object of the present invention to provide a chair having a back tilt mechanism that is relatively simple in its construction, and that is amenable to a variety of different base designs including four-leg, sled, and pedestal bases. It is a further object of the invention to provide a chair that includes a relatively flexible backrest capable of bending to conform to a user of the chair. Yet another object of the present invention is to provide a chair that is relatively low in cost while maintaining the features of more expensive tiltable chairs.

SUMMARY OF THE INVENTION

In accordance with a first aspect of the present invention, a chair has a base interconnected with a backrest and seat. A pair of tilt mechanisms are mounted at each side of the base and positioned between the backrest and the seat. The tilt mechanisms are configured to allow for rearward movement of the backrest relative to the seat when a user of the chair applies a rearward thrust to the backrest and to elastically return the backrest to its initial resting position upon removal of the rearward thrust. Each tilt mechanism includes a dual-cantilevered U-shaped spring horizontally mounted to the base and secured to the backrest to allow for tilting of the backrest relative to the seat upon the application of a rearward force to the backrest. Upon removal of the rearward force, the U-shaped springs are configured to urge the backrest back to its initial position. The U-shaped springs are preferably horizontally mounted on the base of the chair. Further, the U-shaped springs include a rounded end opposite a dual-cantilevered end. The rounded end is configured to position the backrest in its initial resting position and to deform to allow tilting of the backrest relative to the seat.

The chair further includes a pair of backrest mounting assemblies secured to the tilting mechanisms. Each backrest mounting assembly is configured to receive a portion of one of the dual cantilevered U-shaped springs and a portion of the backrest. Further, the backrest mounting assemblies may include a lower clamp and an upper portion coupled to one another, wherein the lower clamp is configured to receive the U-shaped spring and the upper portion is configured to receive a portion of the backrest of the chair.

In accordance with another aspect of the present invention, the chair further provides a relatively flexible backrest. The backrest may include a pair of cantilevered spring rods disposed within the backrest to provide for flexing of the backrest. The cantilevered spring rods are preferably received by the backrest mounting assembly and adapted to mount the backrest to the tilting mechanisms. In addition, the backrest is preferably constructed from a relatively flexible plastic material such as polypropylene or other such materials having similar flexing characteristics. Further, the chair preferably includes horizontal transverse in the backrest to increase the flexibility of the backrest.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
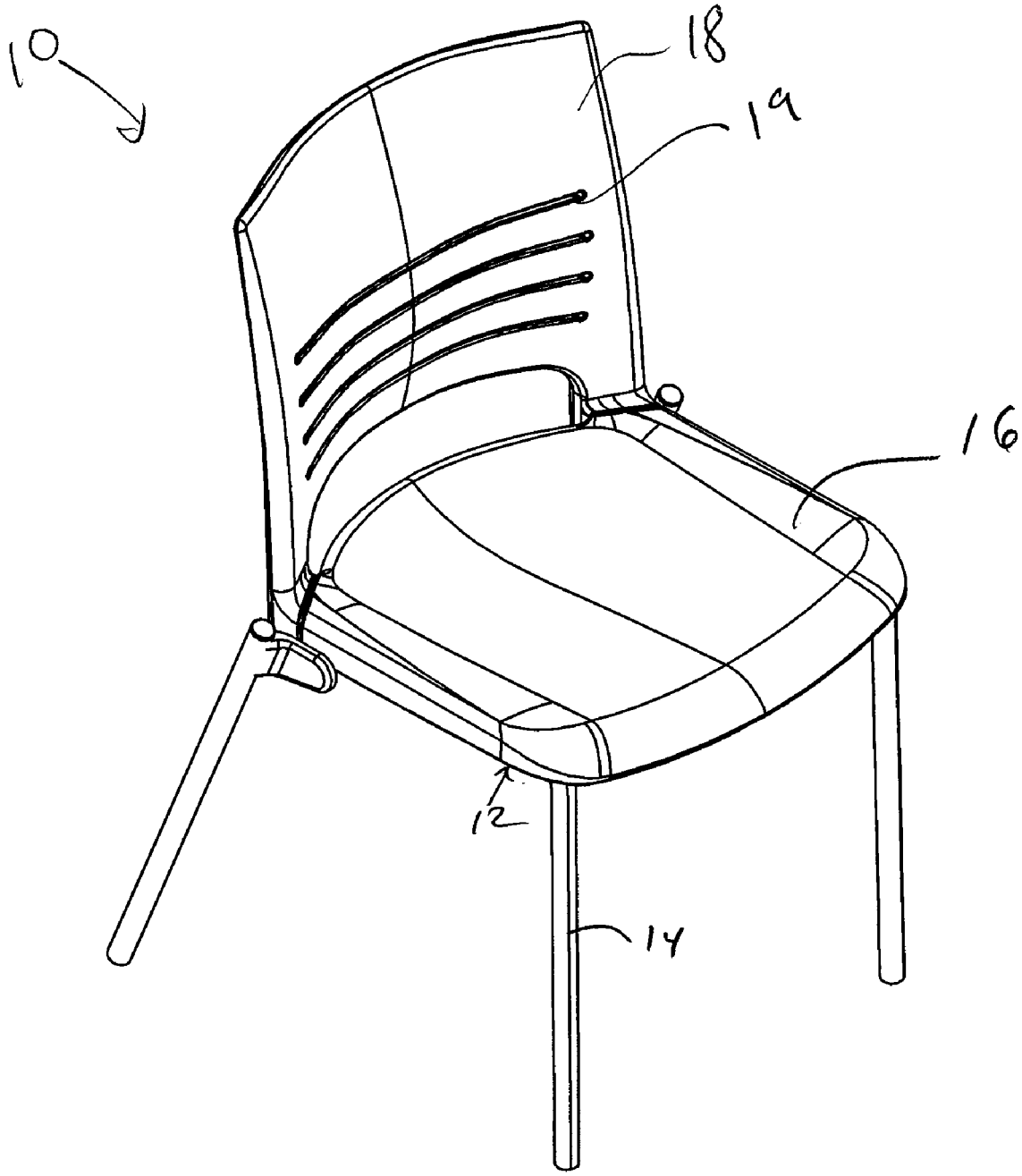
FIG. 1 is an isometric view of a chair having a tiltable backrest, incorporating the features of the present invention, in which the chair is illustrated in an upright position.
Figure 2:
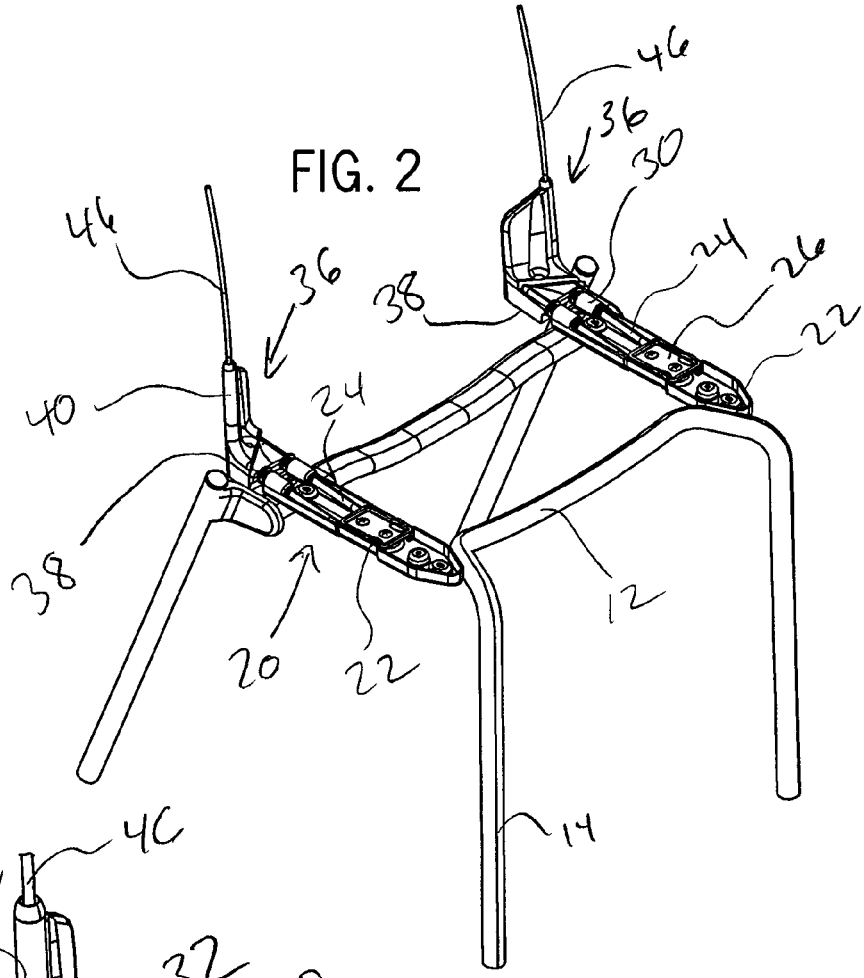
FIG. 2 is a front isometric view of a base and tilt mechanisms in accordance with the present invention, as incorporated into the chair of FIG. 1.
Figure 3:
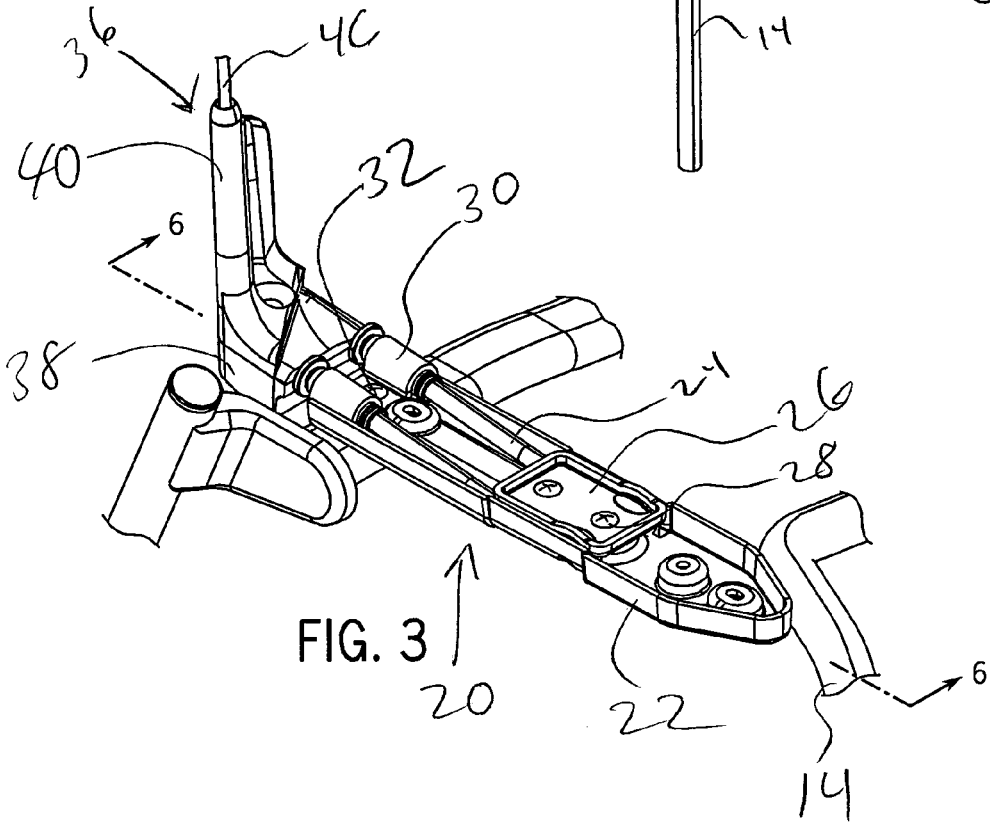
FIG. 3 is an enlarged partial isometric view of one of the tilt mechanisms of the chair of FIG. 1.
Figure 4:
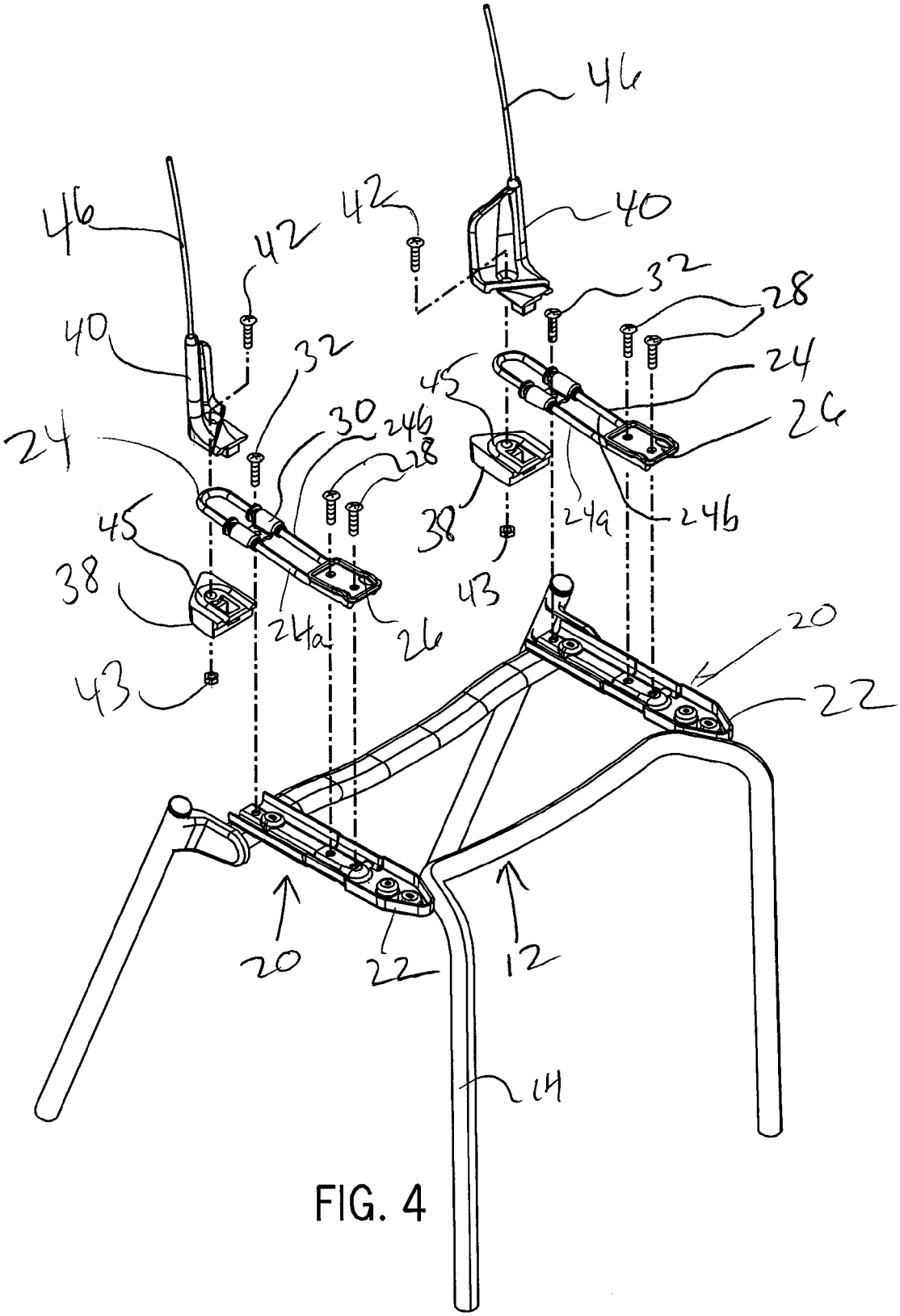
FIG. 4 is an exploded isometric view of the base and tilt mechanisms as in FIG. 2.
Figure 5:
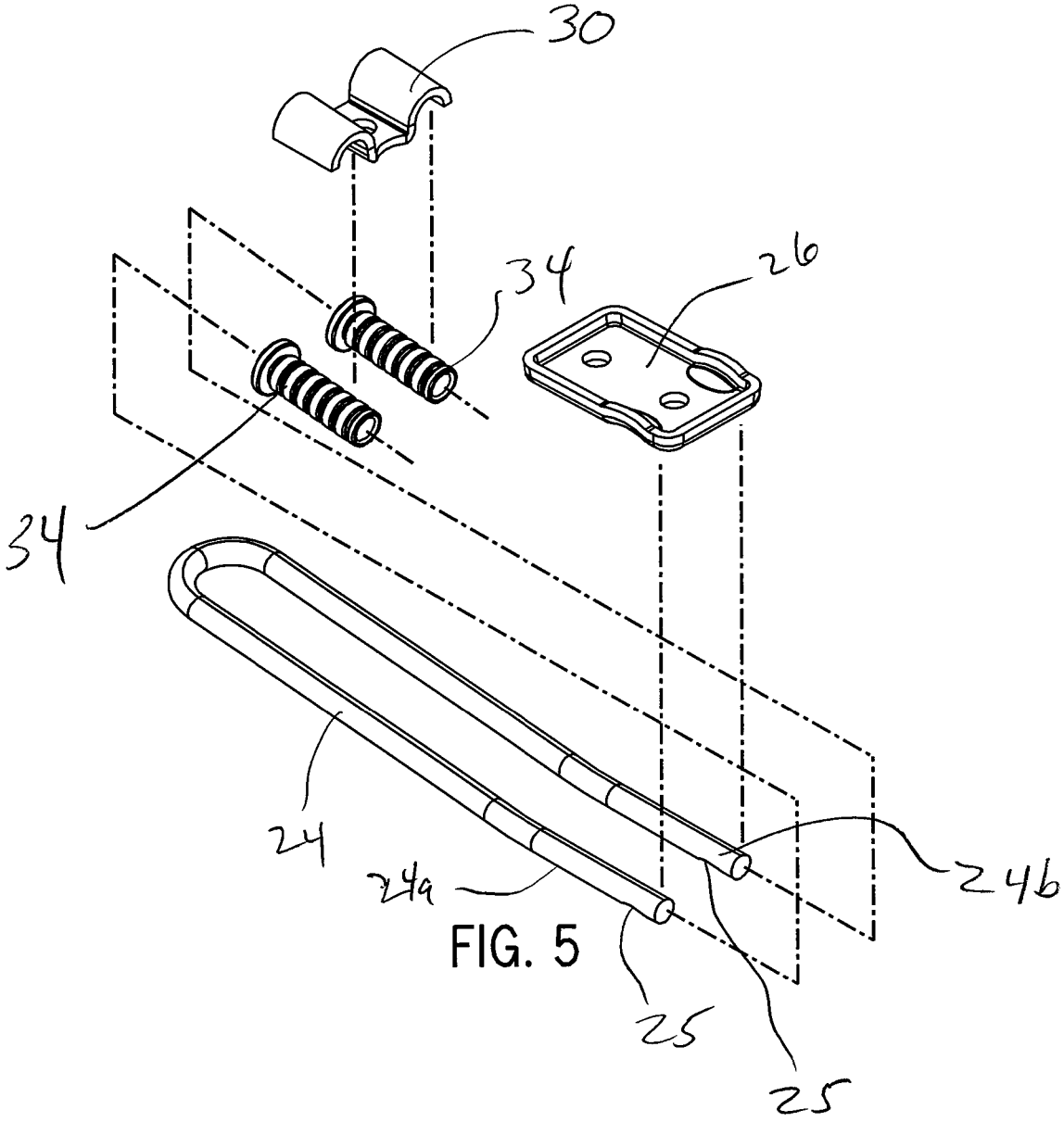
FIG. 5 is a partial exploded view of the tilt mechanism of the chair of FIG. 1.

Referring now to the drawings, and initially FIG. 1, a chair 10 of the present invention includes a base 12 having a set of four legs 14 for supporting the chair 10 on a support surface such as a floor. Base 12 may alternatively comprise a variety of different support structures including, but not necessarily limited to, sled and pedestal supports. A seat 16 is fixedly mounted to the base 12 for supporting the user, and a backrest 18 is tiltably mounted to the base 12 for supporting the user's back. Backrest 18 preferably includes slots 19 configured to provide the backrest with increased flexibility. The seat 16 and backrest 18 are preferably constructed from a relatively flexible material such as polypropylene or other similar such materials configured to provide flexibility to backrest 18.

Turning now to FIGS. 2-7, the chair 10 of the present invention includes a pair of tilt mechanisms 20 are mounted one on each side of the base 12 between the seat 16 and the backrest 18. Each tilt mechanism 20 includes a stationary support member 22 configured to provide a mounting location for the seat 16 and to provide the structural foundation for the chair 10 of the present invention. Each support member 22 is adapted to receive and retain a dual-cantilevered U-shaped spring 24. U-shaped springs 24 are preferably constructed from spring steel or similar such materials. By bending the steel springs into a U-shape, the resulting U-shaped springs 24 provide each side of the chair with a pair of flexing members 24*a*, 24*b* that accommodate tilting of the backrest 18 relative to the seat 16. Each U-shaped spring 24 includes a rounded outer end opposite a cantilevered inner end at which the pair of flexing members 24*a* and 24*b* are both mounted in place.

Figures 6, 7:
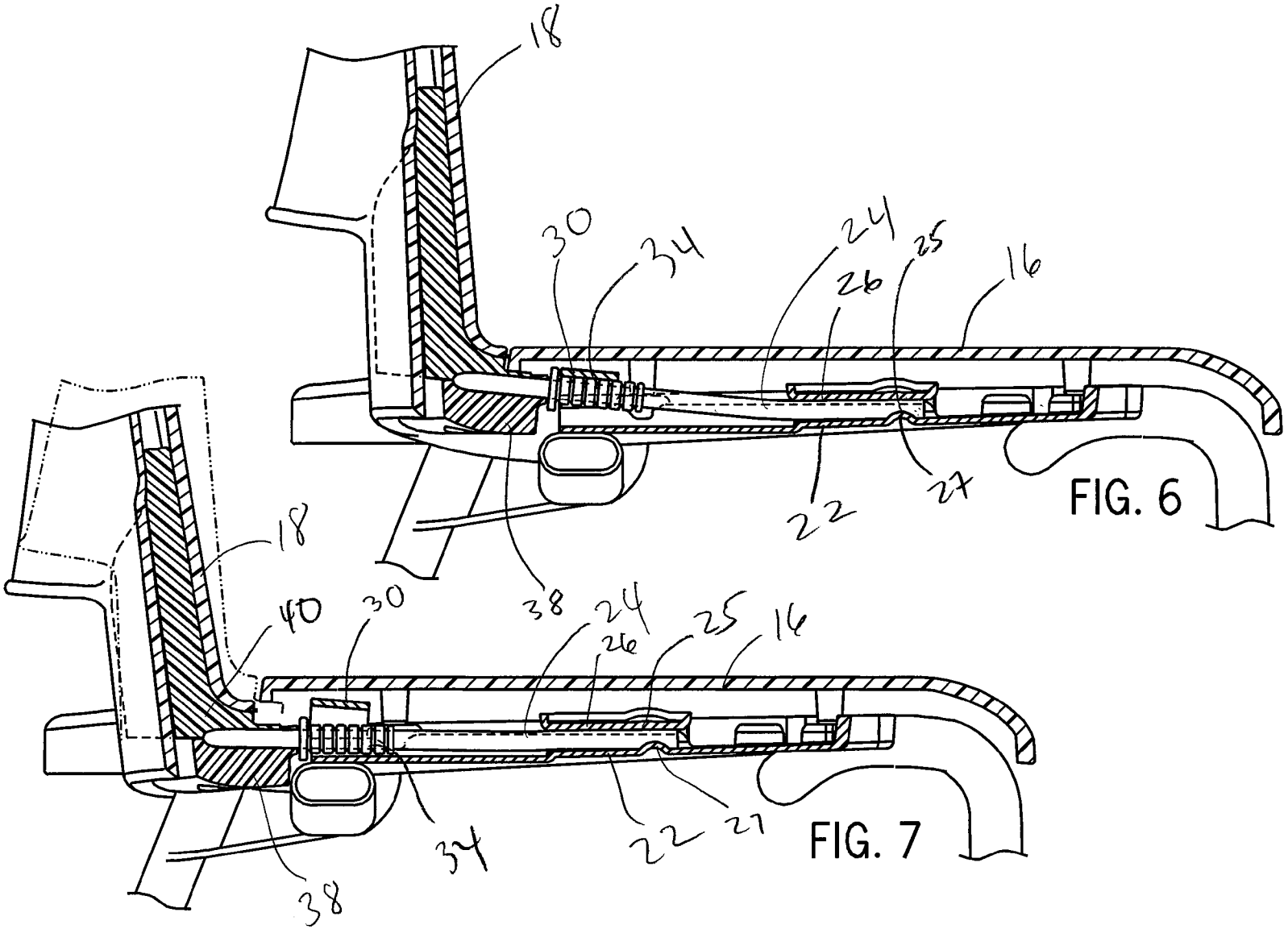
FIG. 6 is a cross sectional view taken along line 6-6 of FIG. 3, showing the backrest in the upright position.
FIG. 7 is a cross sectional view like that of FIG. 6 showing the backrest in the reclined position.

Referring now to FIG. 6, each flexing member 24*a* and 24*b* of the U-shaped spring 24 includes an indentation or upset 25 along a portion thereof. Each upset 25 is configured to matingly receive a corresponding projection 27 disposed within support member 22 to ensure proper placement of the U-shaped springs 24 within the support members 22 during assembly.

Referring again to FIGS. 2-7, U-shaped springs 24 are held in place at the cantilevered end by a plate 26 or similar such retaining member. Each plate 26 is secured to its respective support member 22 by a pair of screws 28 to secure the U-shaped spring 24 between the plate 26 and support member 22. Opposite the cantilevered inner end, the rounded portion of the U-shaped spring 24 constrained by a limiting stop 30 that is fastened to the support members 22 by way of a screw 32 or similar such fastener. Preferably, a pair of bushings 34 are provided on the U-shaped springs 24 and are located beneath the stop 30. Bushings 34 are preferably tubular bumper bushings configured to provide an abutting surface to dampen sounds and impact at the ends of travel of the U-shaped springs 24. The stop 30 is positioned within support member 22 to set a resting position for the backrest 18 of the chair 10 of the present invention as well as to establish a preload on the U-shaped springs 24.

A pair of back mounting assemblies 36 are provided at the rear of the support members 22, and are configured to provide a support for mounting the backrest 18 to the base 12 of the chair 10 of the present invention. The back mounting assemblies 36 of the present invention are generally "handed," i.e., configured for use on either the right-hand or left-hand side of the chair 10 while the other components of the chair 10 of the present invention are preferably identical and capable of use on either side. Alternatively, the back mounting assemblies 36 may be configured to work on either side of the chair 10 of the present invention. The back mounting assemblies 36 generally comprise a lower clamp 38 and an upper portion 40. Lower clamp 38 generally defines an upper surface that is formed with a rounded groove 45 configured to receive the rounded outer end of the U-shaped spring 24. Lower clamp 38 is generally aligned with support member 22 of chair 10. Upper portion 40 generally defines a lower surface that is formed with a rounded groove, similar to groove 45, which is configured to receive the rounded outer end of the U-shaped spring 24. Upper portion 40 is coupled to the lower clamp 38 to secure the rounded outer end of the U-shaped spring 24 between the lower clamp 38 and upper portion 40. Preferably, the lower clamp 38 and upper portion 40 are coupled to one another by way of a screw 42 and nut 43. Alternatively, lower clamp 38 and upper portion 40 may be coupled to one another by a bolt or other such fastener.

Upper portion 40 includes a passage on its upper end that is adapted to receive one end of a cantilevered spring rod 46. The other end of spring rod 46 is received within the backrest 18 to securely mount the backrest 18 on the back mounting assembly 36. Spring rods 46 are further adapted to provide flexibility to the backrest 18.

Referring to FIGS. 6 and 7, the movement of the backrest 18 from an initial upright position to a reclined position is shown. First, as shown in FIG. 6, the chair 10 of the present invention is shown with backrest 18 in its initial, upright position wherein the U-shaped spring 24 is shown with its rounded end generally positioned upwardly with respect to the base 12 of the chair 10. The upward bias of the rounded end of the U-shaped spring 24 serves to urge the backrest 18 of the chair 10 to its at-rest position. Opposite the rounded end of U-shaped spring 24, the flexible members 24*a* and 24*b* of the cantilevered end of the U-shaped spring are held in place by plate 26. Bushings 34 work in conjunction with U-shaped spring 24 to provide an abutment surface in coordination with stop 30 to set the at-rest position of the backrest 18.

Now turning to FIG. 7, the chair 10 of the present invention is shown with the backrest 18 tilted rearwardly with respect to the seat 16. Upon application of a rearward thrust applied by a user against the backrest, the rounded end of U-shaped spring 24 is deflected downwardly by the upper portion 40, which urges the back mounting assembly 36 downwardly to allow the entire backrest 18 to tilt rearwardly. Downward movement of the U-shaped spring 24 is limited by the stationary support member 22 coming into contact with bushings 34, which acts as a stop to limit the degree of incline of the backrest 18. Upon removal of the rearward force, the chair 10 is returned toward its initial position shown in FIG. 6 by the upward bias of the U-shaped springs 24 against backrest 18.

While the features of the invention have been shown and described in connection with a specific embodiment, it is understood that various alternatives and modifications are contemplated as being within the scope of the present invention. It is also understood that the features of the present invention may be used separately or in various subcombinations.

Various alternatives and embodiments are contemplated as being within the scope of the following claims, which particularly point out and distinctly claim the subject matter regarded as the invention.

I claim:

1. A chair comprising:

a base;

a seat and a backrest mounted to and supported by the base;

a pair of tilt mechanisms mounted on opposite sides of the base, wherein each tilt mechanism has a U-shaped spring to which the backrest is secured, wherein each U-shaped spring defines a pair of flexing members fixedly secured to the base at an inner end and a rounded outer end opposite the inner end; and a pair of backrest mounting assemblies mounted on opposite sides of the base, the backrest being mounted on the backrest mounting assemblies, wherein the backrest is rearwardly tiltable via the tilt mechanisms from a resting position to a reclined position in response to a rearwards thrust applied to the backrest, and elastically returns to the resting position after removal of the rearward thrust by operation of the tilt mechanisms, wherein the backrest mounting assemblies are mounted to the tilt mechanisms and wherein each backrest mounting assembly comprises a lower clamp adapted to receive the rounded end of one of the U-shaped springs, coupled to an upper portion that is interconnected with the backrest.

2. The chair of claim 1, further comprising a pair of cantilevered spring rods each having a first and a second end, wherein the first end is received within the backrest and the second end is received by the upper portion of one of the backrest mounting assemblies.

3. The chair of claim 2, wherein each backrest mounting assembly is configured to force the rounded outer end of the U-shaped spring downwardly under a rearward thrust applied to the backrest to allow for tilting of the backrest relative to the seat.

4. The chair of claim 1, wherein the U-shaped springs are horizontally mounted on the base.

5. A chair comprising:

a base;

a seat and a backrest mounted to and supported by the base;

a pair of tilt mechanisms mounted on opposite sides of the base, wherein each tilt mechanism has a U-shaped spring to which the backrest is secured, wherein each U-shaped spring defines a pair of flexing members fixedly secured to the base at an inner end and a rounded outer end opposite the inner end; and a pair of bushings disposed on each U-shaped spring, the bushings being configured to engage a respective of each tilt mechanism and to dampen sound and impact at the rounded end of the U -shaped spring;

wherein the backrest is rearwardly tiltable via the tilt mechanisms from a resting position to a reclined position in response to a rearwards thrust applied to the backrest, and elastically returns to the resting position after removal of the rearward thrust by operation of the tilt mechanisms, wherein the stop of each tilt mechanism further includes a stop configured to set the resting position of the backrest and provide a predetermined amount of preload on the U-shaped spring.

6. A tilt mechanism for use with a chair having a seat and a backrest coupled to a base, the tilt mechanism comprising:

a U-shaped spring mountable on the base having a rounded outer end and a cantilevered inner end, wherein the cantilevered inner end comprises a pair of flexing members;

a backrest mounting assembly interconnectable with the backrest and the outer end of the U-shaped spring; and a support member configured to be positioned adjacent the base of the chair, wherein the support member receives a portion of the U-shaped spring and defines a mounting location for the seat;

wherein the backrest mounting assembly is urged downward upon application of a rearward force to the backrest of the chair such that the rounded end is deflected downwardly to enable the backrest to tilt rearwardly with respect to the seat of the chair, wherein the backrest of the chair elastically returns to an initial position upon removal of the rearward force in response to an upward biasing force applied by the U-shaped spring, and wherein each of the flexing members includes an indentation configured to receive a protrusion associated with the support member.

7. A tilt mechanism for use with a chair having a seat and a backrest coupled to a base, the tilt mechanism comprising:

a U-shaped spring mountable on the base having a rounded outer end and a cantilevered inner end, wherein the cantilevered inner end comprises a pair of flexing members;

a backrest mounting assembly interconnectable with the backrest and the outer end of the U-shaped spring;

a stop configured to set an initial position of the backrest; and a pair of bushings disposed on the U-shaped spring, the bushings being adapted to engage the stop and to dampen sound and impact at the rounded end of the U-shaped spring, wherein the backrest mounting assembly is urged downward upon application of a rearward force to the backrest of the chair such that the rounded end is deflected downwardly to enable the backrest to tilt rearwardly with respect to the seat of the chair and wherein the backrest of the chair elastically returns to the initial position upon removal of the rearward force in response to an upward biasing force applied by the U-shaped spring.

* * * * *

UNITED STATES PATENT AND TRADEMARK OFFICE

CERTIFICATE OF CORRECTION

PATENT NO. : 7,681,952 B2
APPLICATION NO. : 12/134752
DATED : March 23, 2010
INVENTOR(S) : Piretti It is certified that error appears in the above-identified patent and that said Letters Patent is hereby corrected as shown below:

In the Claims:

Column 5, Claim 5, Line 5, please insert --stop-- after respective;

Column 5, Claim 5, Lines 14-15, please delete "further includes a stop" and insert --is-- therefor.

Signed and Sealed this

Twenty-ninth Day of June, 2010

David J. Kappos

David J. Kappos
*Director of the United States Patent and Trademark Office*